US005850788A

United States Patent [19]

Janser et al.

[11] Patent Number: 5,850,788

[45] Date of Patent: Dec. 22, 1998

[54] METERING STRIP

[75] Inventors: Herbert Janser, Bolligen, Switzerland; Eugen Zwahlen, Bern, Switzerland; Peter Gertsch, Niederscherli, Switzerland; Robert Imhof, Bern, Switzerland

[73] Assignee: Maschinenfabrik WIFAG, Bern, Switzerland

[21] Appl. No.: 933,577

[22] Filed: Sep. 19, 1997

Related U.S. Application Data

[63] Continuation-in-part of Ser. No. 003,548, Jan. 13, 1993, abandoned.

[30] Foreign Application Priority Data

Jan. 14, 1992 [DE] Germany ..... 42 00 769.0

[51] Int. Cl.[6] ..... B41F 31/00

[52] U.S. Cl. ..... 101/350.6; 101/157

[58] Field of Search ..... 101/154, 155, 101/157, 167, 169, 350.5, 350.6

[56] References Cited

U.S. PATENT DOCUMENTS

| | | | |
|---|---|---|---|
| 3,113,225 | 12/1963 | Kleesattel et al. | 101/350 |
| 4,505,987 | 3/1985 | Yamada et al. | 428/553 |
| 4,601,242 | 7/1986 | Fadner | 101/348 |
| 4,796,549 | 1/1989 | Okamura | 101/169 |
| 4,870,899 | 10/1989 | Bowden | 101/167 |
| 4,960,643 | 10/1990 | Lemelson | 384/907.1 |

FOREIGN PATENT DOCUMENTS

| | | | |
|---|---|---|---|
| 2205781 | 12/1988 | United Kingdom | 101/157 |

*Primary Examiner*—Ren Yan
*Attorney, Agent, or Firm*—McGlew and Tuttle

[57] ABSTRACT

A metering strip for an ink fountain of a printing press for metering printing ink, especially a doctor blade, is fastened in a pivoting mount and has a cylindrically shaped edge with a radius in the range between 0.3 and 1.5 mm. The edge is pressed against an inking roller and forms a metering nip with this roller for the printing ink to be metered. Axial recesses merge on both sides of the metering strip with the cylindrically shaped, wear-resistant edge that covers an angular range of more than 180°.

19 Claims, 4 Drawing Sheets

METERING STRIP

This is a continuation-in-part application of application Ser. No. 08/003,548 filed Jan. 13, 1993, now abandoned.

FIELD OF THE INVENTION

This invention relates to a metering strip for the inking system of a printing press such as a doctor blade, wherein the metering strip is fastened to a pivoting mount and is provided with a cylindrically shaped edge with a radius (typically in the range between 0.3 and 1.5 mm) wherein the edge is pressed against an inking roller to form a metering nip with the inking roller for the printing ink to be metered.

BACKGROUND OF THE INVENTION

In known printing presses, a paper web to be printed passes between two rotating cylinders of the printing press inking system and is printed there. At least one of these two cylinders is designed as a rubber blanket cylinder onto which the printing ink is transferred by other preceding rotating cylinders or rollers of the ink fountain. The printing ink, which may have a high viscosity, is applied to the first of these rollers, and is transported optionally over other rollers to the mentioned rubber blanket cylinder. To pick up the printing ink, the inking roller may be partly immersed in a bath of printing ink to entrain ink while rotating, or a suitable inking device may be positioned over the entire width of the inking roller. The ink film formed in this way on the inking roller must then be adjusted to the desired thickness by an appropriate metering device. This is usually done by a so-called doctor blade that extends along the entire length of the inking roller used for ink transfer whereat the doctor blade is pressed against the roller.

A metering device for the ink fountain of a printing press for stripping off a premeasured ink film onto an inking roller to the extent necessary for the subsequent transfer to a plate cylinder is disclosed by German publication DE-C 37 14 936. This metering device has at least one metering strip that extends along the inking roller and is pressed against this roller. The metering strip stands essentially radially to the inking roller so that a metering nip develops between the roller and the edge of the metering strip facing the roller. The edge of the metering strip facing the roller has a cylindrical shape. To change the angle of incidence of the metering strip on the roller, the metering strip can pivot around the axis of the cylinder defined by the cylindrically shaped edge. To make it possible for the metering strip to pivot around this axis within a limited angular range, the metering strip is mounted in a mount at its end faces by bearing journals whose axis of rotation coincides with the axis of the cylinder defined by the cylindrically rounded edge. The embodiments of metering strips disclosed by this publication and the metering devices comprising such metering strips including the mentioned mount for the metering strip are prior art.

It has proved to be a disadvantage in the metering strip disclosed by DE-C 37 14 936 that for design reasons, only a relatively small pivot angle of less than 30° is permitted, i.e., ±15° around the central axis, since otherwise the width of the metering nip between the roller and the metering strip would become unacceptably large with further pivoting of the metering strip. This would involve an adverse change of the film thickness of ink applied to the roller. On the other hand, however, the more viscous the printing ink used, the more advantageous it is to pivot away by an angle larger than the mentioned 30°. With a metering strip pivoted only slightly, there is a buildup of ink stripped off of the metering strip and running freely off in the edge area between the roller and the metering strip, especially when using high-viscosity printing ink.

To protect the very precisely machined metering edge of the metering strip, it is also suggested in DE-C 37 14 936 that the metering edge be covered over with a pliable, filmlike plate that is fastened so that it can be replaced easily and simply. The wear resistance is thus achieved by higher design cost, which in addition to the filmlike, wear-resistant plate also requires locking devices for this plate.

SUMMARY AND OBJECTS OF THE INVENTION

It is an object of the invention to provide a metering strip for an ink fountain of a printing press, especially printing presses with short offset inking mechanisms in conjunction with a smooth roller, and/or an inking system of a printing press with hard printing form such as a short offset inking system with an ink applicator roller, while avoiding the drawbacks familiar from the state of the art. In particular, the metering strip according to the invention is to be provided with a simple structure to define an exact metering nip and is to guarantee the free runoff of the excess stripped ink applied to the inking roller, particularly when using high-viscosity ink.

According to the invention, a metering strip assembly is provided for an ink fountain of a metering press for metering printing ink, particularly a doctor blade assembly, wherein the metering strip is fastened to a pivoting mount and the metering strip defines a cylindrically shaped edge with a radius typically in the range between 0.3 and 1.5 mm. When pressed against an inking roller, a metering nip is formed with the roller for the printing ink to be metered. A cylindrical shaped edge covers an angular range of more than 180° (one hundred and eighty degrees). The cylindrical shaped edge mergers on both sides with recesses formed in the metering strip and provides the transition region between the cylindrically shaped edge (of more than 180°) and a supporting portion of the metering strip. The metering strip cylindrically shaped edge is preferably formed of a wear resistant material.

The angular range of the cylindrically shaped edge is preferably between 200° (two hundred degrees) and 280° (two hundred and eighty degrees). According to the invention, the angular range is optimally about 250° (two hundred and fifty degrees). The transition region between the cylindrically shaped edge and the recess is continuous. The cylindrical shaped edge and the supporting part, extending into a pivot mount, are preferably of a one-piece design, formed integrally. The metering strip includes a cylindrical edge, the support part extending to the pivot mount and the transition region carrying the recess wherein these parts are connected ridgedly to one another. The wear resistant design of the cylindrically shaped edge may be wear resistant ceramic, sintered metal or plastic material.

The advantage of this invention is based on the fact that the cylindrically shaped edge of a metering strip facing an inking roller covers an angular range of more than 180°, and merges into axial recesses on both sides of the cylindrically shaped edge on the metering strip. Since the cylindrical edge of the metering strip pursuant to the invention covers a far larger angular range than the previously known versions from the state of the art, the angular range by which such a metering strip can be pivoted can be effectively increased without the adverse side effect of the cylindrical edge of the metering strip being moved away from the surface of the inking roller, which would produce an adverse widening of the nip. It is desirable to pivot the metering strip away by the largest possible angle precisely when using high-viscosity printing ink in order to facilitate the free runoff of the ink. In contrast to the known metering strips, a metering strip designed pursuant to the invention can definitely be pivoted by an angle of almost ±90° from the normal position radial to the inking roller. Since the metering strip pursuant to the invention can be pivoted within a large angular range, a relatively large amount of frictional work can be introduced by oscillating motion of the metering strip to distribute particularly high-viscosity ink uniformly in the area of the point of contact between the inking roller and the metering strip. The recesses pursuant to the invention merging with the cylindrically shaped edge of the metering strip provide for the stripped ink being able to flow off from this cylindrical edge without backup into the recesses and from there back along the following part of the metering strip serving as a guide for the ink, into an ink collecting tank. The merging of the recesses with the cylindrically shaped edge likewise provides for the desired large pivoting range of the metering strip. The structural advantage brought about by the invention is further assisted by a wear-resistant design of the cylindrical edge of the metering strip, since for example covering the cylindrical edge with a wear-resistant, filmlike plate can be omitted. Specifically, a metering strip covered over with such a plate would have too complicated a structure to allow the structural advantages of the invention to come to bear.

The cylindrically shaped edge of the metering strip pursuant to the invention preferably covers an angular range between 200° and 280°; coverage of about 250° is especially desirable.

It is especially beneficial for the transition area between the cylindrically shaped edge of the metering strip and the recesses located on both sides to be continuously shaped so that the cylindrical edge in tangential extension merges into a rounded recess or channel, which in turn continuously changes into the following part of the metering strip on which the stripped printing ink flows off, to be collected in a collecting basin or the like.

According to the invention, the metering strip can be of one-piece design; on the other hand, however, it can also consist of several parts, including at least the cylindrical edge, a part placed in a pivoting mount, which extends into the mount from the cylindrical edge, and another part carrying the recess, which are connected to one another rigidly in a suitable way. However, the one-part metering strip represents a particularly preferred form of embodiment because in this case the highest dimensional accuracies are achievable, especially over the entire length of the metering strip. Specifically, fitting problems from combining several parts, for example by cementing or welding, can be avoided. This advantage of one-part integrity is of very special importance for a metering strip several pages wide, such as that used in so-called panorama printing, for example.

The shape of the metering strip pursuant to the invention in the area of the point of contact with the inking roller and the part extending into the pivoting mount with recesses on both sides can be made by shaped grinding or milling, spark erosion, or other suitable machining methods.

To produce the desired wear resistance, the metering strip can consist of a suitable solid material, but preferably only the cylindrically shaped edge is made wear-resistant by using a suitable material, for example such as ceramic, sintered metal, or a wear-resistant plastic. It is also sufficient to make only its surface wear-resistant, which can be done advantageously by applying a suitable coating, for example carbides, nitrides, oxides, etc. Such a coating may be by vapor deposition such as a vapor-deposited metal film.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS In the drawings.

DETAILED DESCRIPTION OF THE PREFERRED EMBODIMENT

Figure 3:
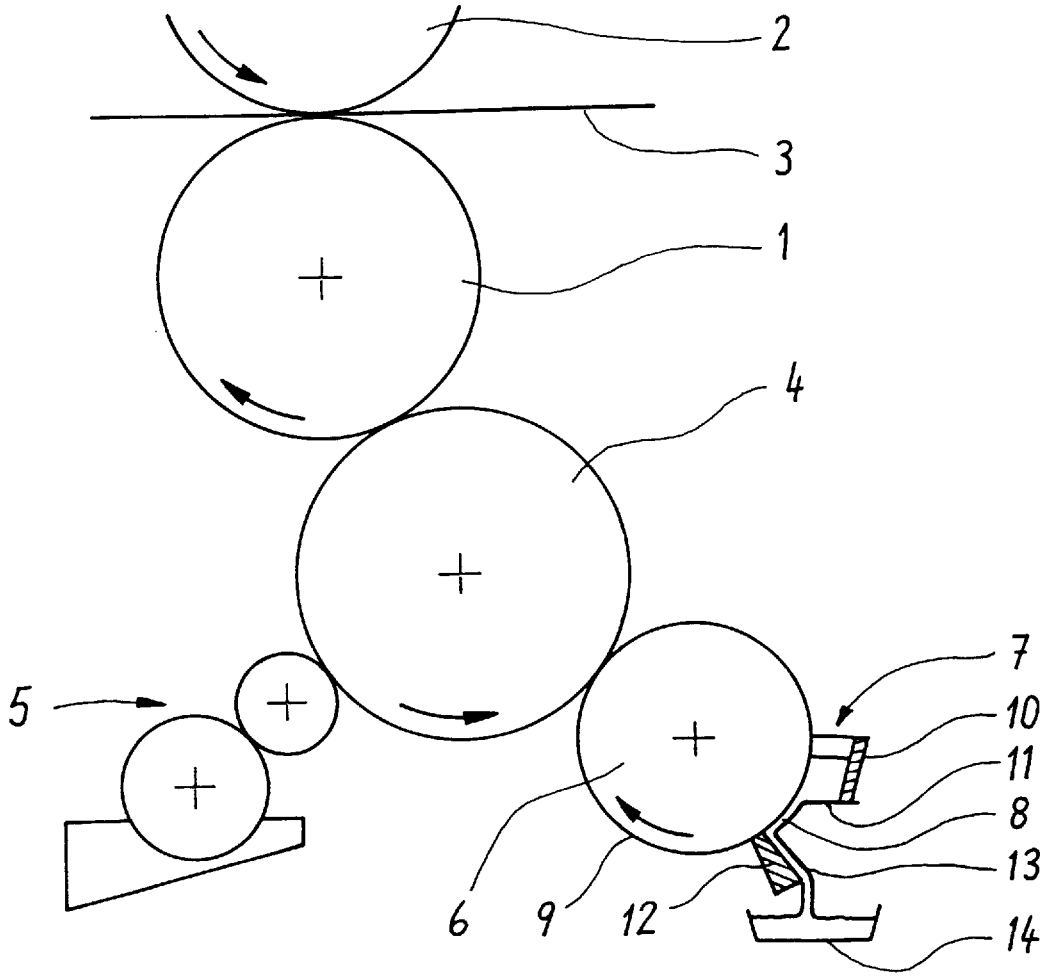
Fig 3 Prior Art
FIG. 3 is a schematically shown inking system of a known rotary offset printing press with ink fountain and water fountain, and a known metering device used.

The inking system of a rotary offset printing press illustrated schematically in FIG. 3 has a rubber blanket cylinder 101 against which a backup cylinder 102 is set, which can also have the design of another rubber blanket cylinder. A paper web 103 to be printed is fed between the rubber blanket cylinder 101 and the backup cylinder 102 and printed. An inking roller 106 with an elastic surface is in contact with a plate cylinder 104 which serves to transfer the ink from the inking roller 106 to the rubber blanket cylinder 101. A premeasured ink film 108, whose thickness is a multiple of that of the ink film 109 transferable to the plate cylinder 104, that has a constant dimension over the entire width of the inking roller 106, is fed to the inking roller 106 by an inking device or means 107. The inking device 107 in this form of embodiment has an ink box 110 that is provided with an inking blade 111 adjustable in a known way that determines the metering. Part of the premeasured ink film 108 that is taken up by the inking roller 106 is then stripped by a metering strip (which pivoted metering strip is improved according to the present invention) 112 following the inking device 107, which in its normal position stands about perpendicular to the inking roller 106, i.e., in about the radial direction. The ink film 109 transferable to the plate cylinder is thus formed. The excess ink 113 stripped off by the metering strip 112 runs along the metering strip 112, but otherwise freely, into a collecting tank 114, and is pumped back from there into the inking device 107 again.

The ink film 109 transferable to the plate cylinder 104 has a constant thickness over the entire width of the inking roller 106. This thickness can be adjusted by more or less acute incidence of the metering strip on the inking roller 106, which can be done with known adjusting mechanisms, not illustrated.

Figure 2:
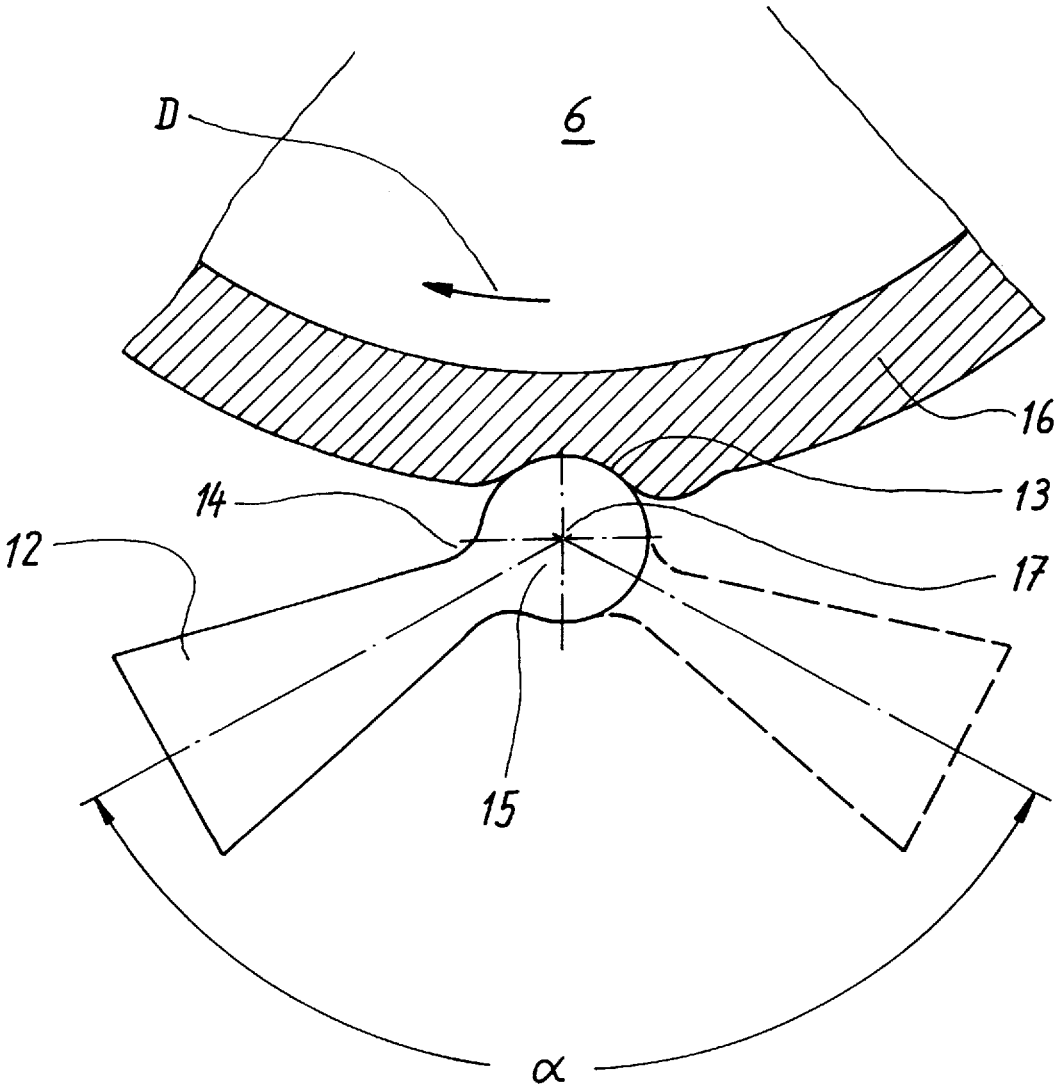
FIG. 2 is a schematic illustration of the pivoted metering strip of FIG. 1.

FIG. 2 shows a cutaway of the inking roller 6 that is in contact with the metering strip (pivoted metering strip) 12 according to the invention. The inking roller 6 has an elastic covering 16 and rotates in the direction of the arrow D. The metering strip 12 has a cylindrical surface at the edge 13 facing the inking roller 6. The axis of symmetry 17 of this cylindrical surface is also the axis of rotation around which the metering strip 12 can be pivoted by the angle α.

Figure 1:
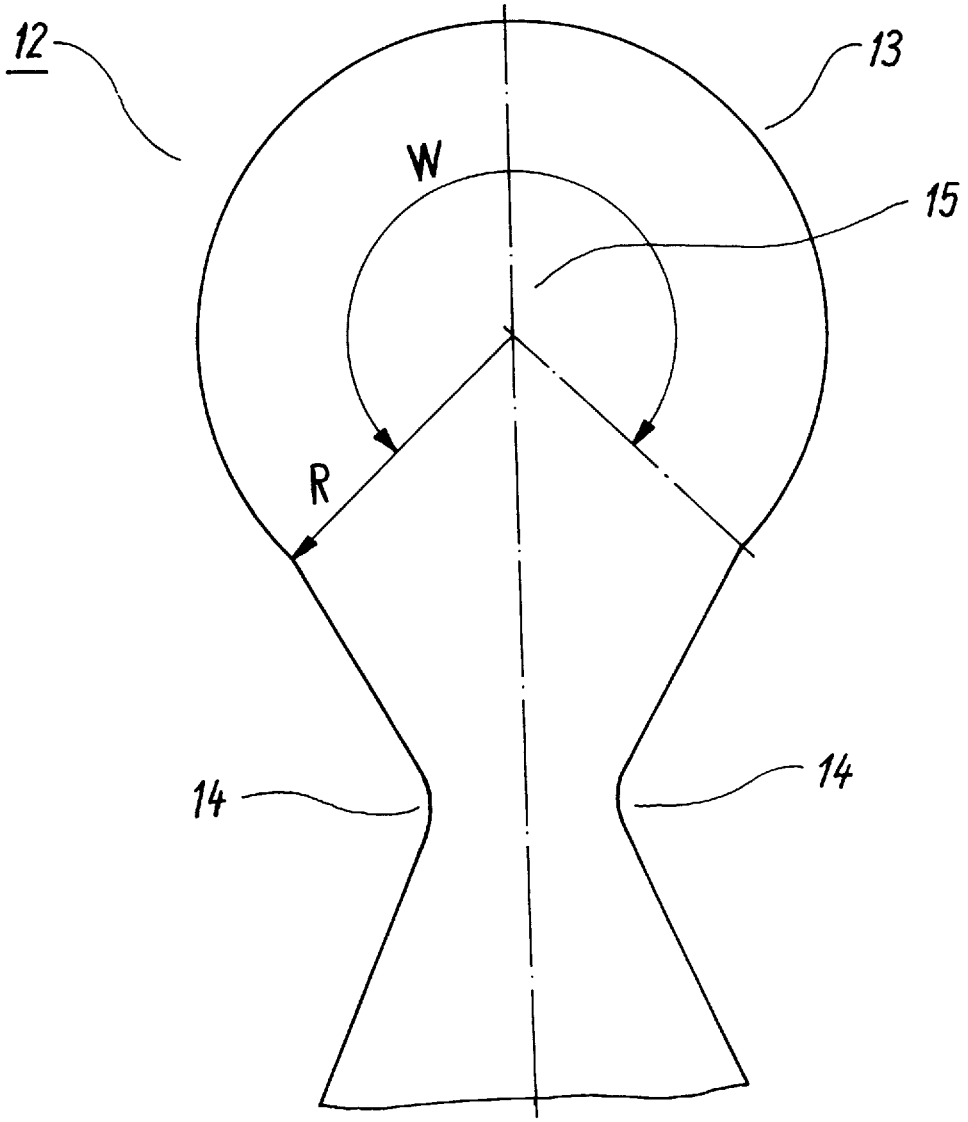
FIG. 1 is a sectional view or end view of a metering strip with a cylindrically shaped edge that covers an angular range of more than 180° and that merges on both sides into recesses formed on the metering strip.

Finally, FIG. 1 shows the metering strip 12 with an edge 13 having a radius R cylindrically shaped over an angular range W, which merges on both sides into axial recesses (undercuts extending in an axial direction) 14 formed in the metering strip 12. The recesses 14 have essentially a V-shape so that the cylindrically shaped part 13 merges in tangential extension on both sides into the recesses 14. The narrowest point of the metering strip 12 defined by the recesses 14 on both sides is rounded to assist the runoff of the stripped printing ink. Thus, this metering strip 12 includes a runoff means with an almost continuous runoff surface for the stripped printing ink.

The radius R of the cylindrically shaped edge 13 of the metering strip 12 is in the range between 0.3 and 1.5 mm. This cylindrical edge covers an angular range W that is greater than 180°. In the example of embodiment shown, this angular range W is about 250°.

As seen clearly in FIG. 2, the metering strip 12, because of its pronounced cylindrical edge 13 covering more than 180°, with the recesses 14 merging with this cylindrically shaped edge 13 on both sides of the metering strip, can be pivoted over a wide angular range α and thereby makes possible almost any desired incidence toward the inking roller 6. The angular range α usable for pivoting the metering strip 12 can thus amount almost to ±90° based on the normal position, without the free runoff of the stripped ink film being adversely impaired.

Figure 4:
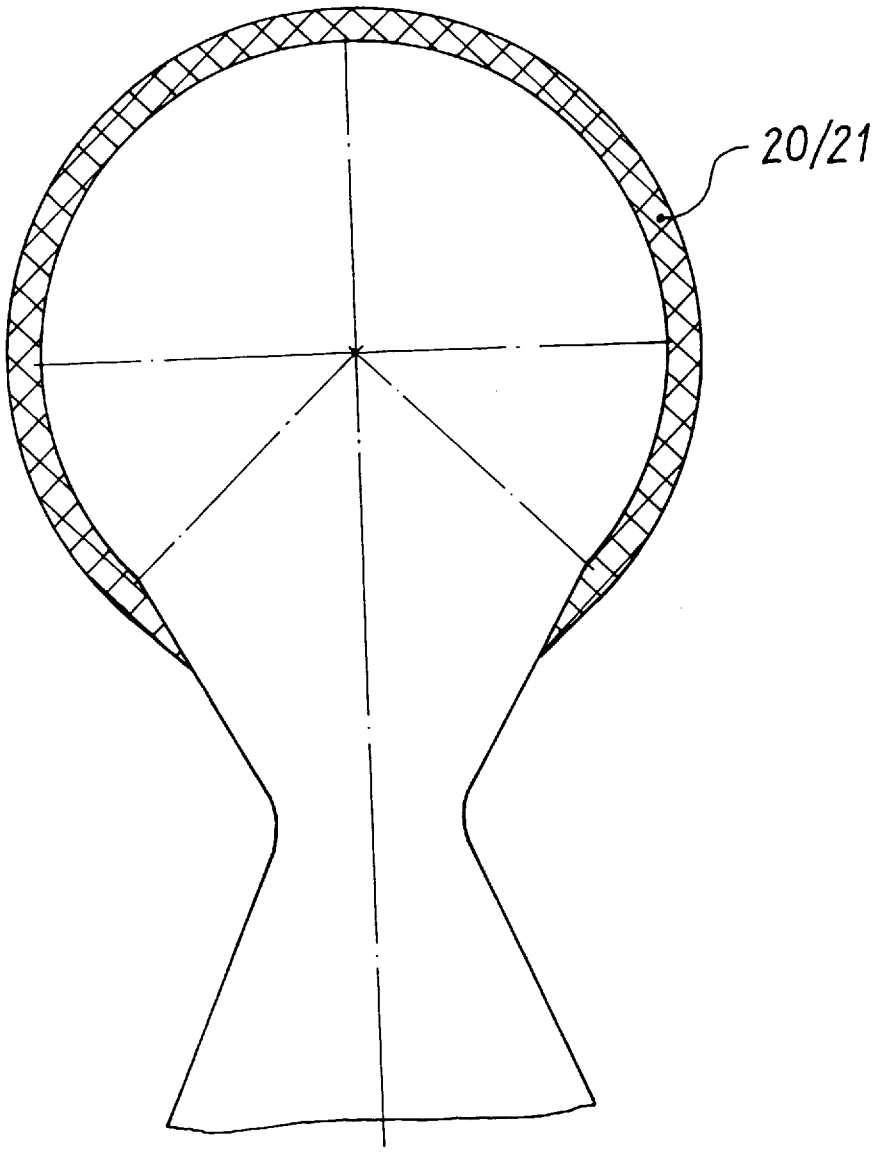
FIG. 4 is a sectional view showing the wear-resistant surface of the cylindrical shaped edge.

FIG. 4 shows the cylindrical surface which is preferably provided with a wear-resistant means 20/21. The wear-resistant means may include a wear-resistant sintered metal, a wear-resistant ceramic material, a wear-resistant plastic material, or a vapor deposited metal film.

While a specific embodiment of the invention has been shown and described in detail to illustrate the application of the principles of the invention, it will be understood that the invention may be embodied otherwise without departing from such principles.

What is claimed is:

1. An inking system in combination with an offset printing press, the system comprising:

an inking roller with a contact surface;

an inking means for applying a first ink film to said contact surface of said inking roller, said first ink film having a first thickness;

a metering strip including a cylindrical shaped edge surface in contact with said inking roller at a position angularly spaced down stream from said inking means, said cylindrical edge surface being pressed into said contact surface to form a metering nip for removing an excess portion of said first ink film and for forming a second ink film downstream of said metering strip, said second ink film having a second thickness less than said first thickness, said metering strip including a support portion extending along said cylindrical edge surface, said cylindrical edge surface extending over an angular range of greater than 180 degrees to form a transition portion with said support portion, said transition portion being shaped to define undercuts forming ink runoff means for guiding said excess portion of said first ink film away from said contact surface of said inking roller, said cylindrical edge surface having an axis of symmetry and said metering strip being pivotable about said axis.

2. An inking system in accordance with claim 1, wherein:

said printing press includes a short offset inking mechanism in conjunction with a smooth roller.

3. An inking system in accordance with claim 1, wherein:

said metering strip is positioned to have said cylindrical edge surface penetrate into said contact surface.

4. An inking system in accordance with claim 3, wherein:

said contact surface is pliable.

5. An inking system in accordance with claim 3, wherein:

said angular range of said cylindrical edge surface is of a magnitude to enable said metering strip to be pivotable by ±90 degrees from a center position without impeding removal of said excess ink.

6. An inking system in accordance with claim 1, wherein:

said angular range of said cylindrical edge surface is of a magnitude to enable said metering strip to be pivotable by 180 degrees without impeding removal of said excess ink.

7. An inking system in accordance with claim 1, wherein:

said cylindrical edge surface and said support portion extending along a length of said contact surface of said inking roller.

8. An inking system in accordance with claim 1, wherein:

said printing press includes a hard form such as a short offset inking mechanism with an ink applicator roller.

9. An inking system in accordance with claim 1, wherein:

said inking means includes an ink box for holding a supply of ink against said inking roller, said inking means also including an ink blade for separating and forming said first ink film from said supply of ink.

10. An inking system in accordance with claim 1, wherein:

said transition portions form a continuous uninterrupted surface for runoff of said excess ink;

said cylindrically shaped edge surface has a radius in a range between 0.3 and 1.5 mm, and covers an angular range between 200 and 280 degrees;

said cylindrically shaped edge includes wear resistant means to resist wear of said cylindrically shaped edge.

11. An inking system in accordance with claim 10, wherein:

said wear resistant means includes a wear-resistant ceramic material.

12. An inking system in accordance with claim 10, wherein:

said wear-resistant means comprises a wear-resistant surface.

13. An inking system in accordance with claim 12, wherein:

said wear-resistant surface is formed of a vapor-deposited metal film.

14. An inking system in accordance with claim 10, wherein:

said wear-resistant means includes said cylindrically shaped surface being formed of a wear resistant sintered metal.

15. An inking system in accordance with claim 10, wherein:

said wear-resistant means includes said cylindrically shaped surface being formed of a wear-resistant plastic material.

16. An inking system in accordance with claim 1, wherein:

said angular range is substantially 250°.

17. An inking system in accordance with claim 1, wherein:

a continuous transition is formed between said cylindrically shaped edge surface and recesses of said transition portion.

18. An inking system in accordance with claim 1, wherein:

said cylindrically shaped edge surface, said transition portion and said support portion are formed integrally of a one-piece design.

19. An inking system in accordance with claim 1, wherein:

said cylindrical edge surface, said transition portion and said support portion are ridgedly connected to one another.

* * * * *